US007356955B2

(12) United States Patent
Dombrowski

(10) Patent No.: US 7,356,955 B2
(45) Date of Patent: Apr. 15, 2008

(54) DISPLAY SYSTEM

(76) Inventor: Leon R. Dombrowski, 7124 Forest Ave., Hammond, IN (US) 46324

( * ) Notice: Subject to any disclaimer, the term of this patent is extended or adjusted under 35 U.S.C. 154(b) by 380 days.

(21) Appl. No.: 10/222,660

(22) Filed: Aug. 16, 2002

(65) Prior Publication Data

US 2004/0200103 A1 Oct. 14, 2004

Related U.S. Application Data

(60) Provisional application No. 60/402,656, filed on Aug. 12, 2002.

(51) Int. Cl.
*G09F 7/00* (2006.01)

(52) U.S. Cl. ..... 40/611.01

(58) Field of Classification Search ..... 40/603, 40/611.01, 611.13, 607.13, 607.01, 606.01; 24/704.1; 160/404, 383, 402, 403
See application file for complete search history.

(56) References Cited

U.S. PATENT DOCUMENTS 3,049,777 A * 8/1962 Lewin ..... 24/620
4,773,174 A * 9/1988 Boeniger et al. ..... 40/792
5,175,911 A * 1/1993 Terrels et al. ..... 24/674
5,357,659 A * 10/1994 Ackermann ..... 24/662
5,579,595 A * 12/1996 Dutton ..... 38/102.1
5,695,346 A * 12/1997 Sekiguchi et al. ..... 434/365
6,269,569 B1 * 8/2001 Doone ..... 40/603

* cited by examiner

*Primary Examiner*—Mark T. Le
(74) *Attorney, Agent, or Firm*—McDonnell Boehnen Hulbert & Berghoff LLP

(57) ABSTRACT

A display system is used to securely and tautly mount a readily changeable advertising display face. The display system comprises a frame that defines a support structure, and a display face removably attached to the support structure. The support structure is adapted to be fixedly mounted to a wall of a building, or a sidewalk, or the like. The support structure and display face have a plurality of interengageable fasteners, e.g., snap members. The display face can thereby be easily attached to and detached from the support structure while hiding the body of the support structure from sight.

7 Claims, 4 Drawing Sheets

DISPLAY SYSTEM

APPLICATION HISTORY

Applicant claims the benefit of prior pending U.S. Provisional Application Ser. No. 60/402,656, filed on Aug. 12, 2002, entitled "Display System."

FIELD OF THE INVENTION

The present invention relates to a system for mounting advertising displays for use on buildings, sidewalks, billboards, etc., as well as the signage made thereby, and, more particularly, to advertising displays that are likely to be changed periodically.

BACKGROUND OF THE INVENTION

Displays with custom-made interchangeable and re-arrangeable display faces or signage are commonly used in establishments such as banks, restaurants, and theaters, among other places, to convey information such as service or product names, prices, graphics, and photographs for the purpose of selling products or giving out information to the public. The display systems typically exhibit their advertisement on a display face, which can be hung on its own, or secured to a support structure either indoors or outdoors.

In some cases, it is desirable to change the display faces. This has led to a number of different approaches to mounting of the changing signage. Naturally, it is the display face itself that is primarily observed by the public. It is thus preferable to have only the display face showing, but in some prior art display systems, the often unsightly support structure or other hanging means is visible to the public. Also, for various reasons including wind forces to which the display systems may be exposed, the display faces can become distorted and difficult to read. Many prior art systems are unable to solve this problem while still retaining an aesthetically pleasing look to the display system, and systems that have the ability to firmly secure the display faces often require a person or persons with special skills necessary to install them.

SUMMARY OF THE INVENTION

It is therefore an objective of the present invention to provide a display system that overcomes the foregoing problems present in prior art systems through the provision of a unique arrangement having a support structure, such as one that may preferably be fixedly mounted to a wall or other appropriate structure, and an engaging mechanism for readily connecting a removably attachable display face thereto.

It is also an aim of the present invention to provide an improved and novel arrangement for securing and tensioning a removably attachable display face or the like to a support structure.

Also in accordance with the present invention, there is provided a system for mounting removably attachable display faces or the like, wherein a support structure has a first part of a first engaging means thereon, with a removably attachable display face having a second part of the engaging means thereon, the second engaging means being approximately at the peripheral edges of the removably attachable display face. Most preferably, the removably attachable display face is sized and shaped to fit snugly over the support structure, such as a frame, such that when the second engaging means of the removably attachable display face is connected to the first engaging means of the support structure, the removably attachable display face completely hides front, side and back surfaces of the support structure from sight, and a tension is created in the removably attachable display face pulling the removably attachable display face taut. One such engaging means contemplated comprises button-type snap fasteners.

An additional object is to provide an improved display system that is portable due to its light weight and can be free standing, hanging or wall mounted.

A further additional object is to provide an improved display system in which it is simple and easy to change removably attachable display faces, and requires no training to do so.

A still further object is to provide an improved display system that is economical in cost to manufacture.

The foregoing as well as other objectives and advantages achieved by the present invention will be further understood upon consideration of the embodiments described in relation to the form illustrated in the accompanying drawings, attention being called to the fact that the drawings are illustrative only, and that changes may be made in the specific construction illustrated and described within the scope of the appended claims.

DETAILED DESCRIPTION OF TWO EMBODIMENTS OF THE INVENTION

Figure 1:
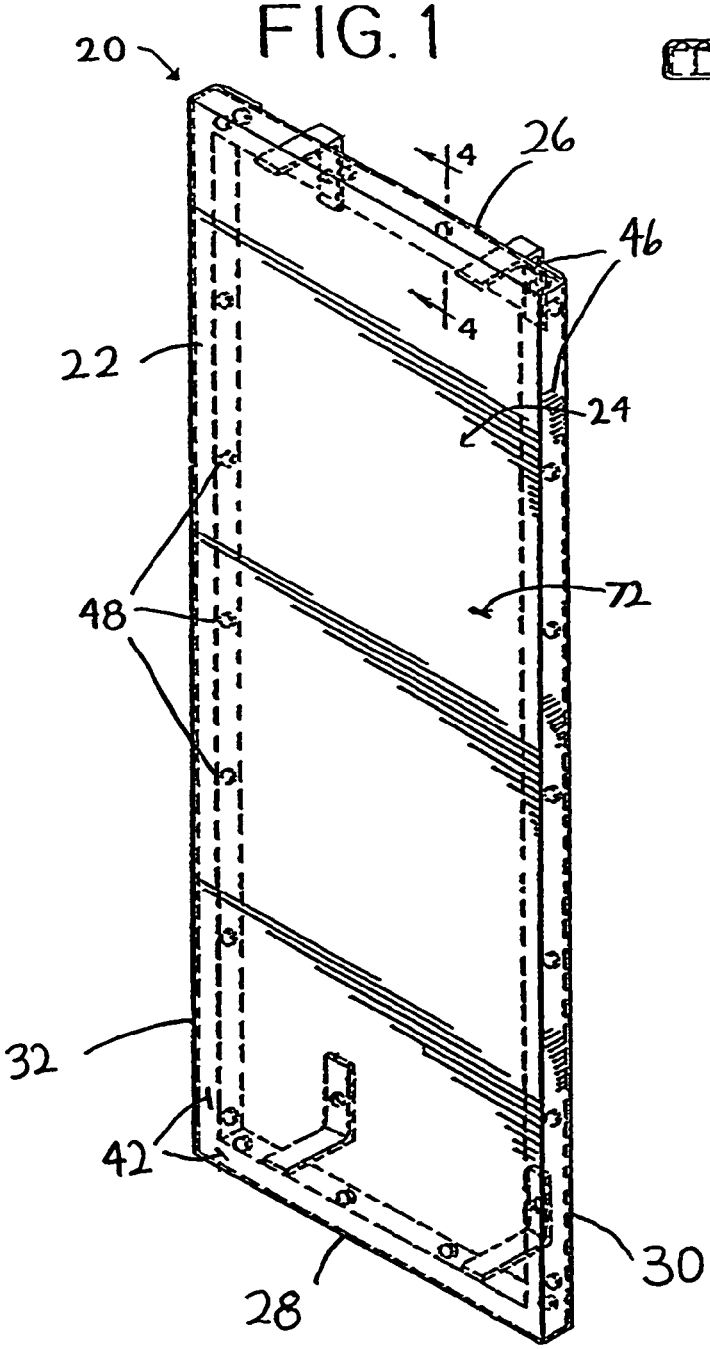
FIG. 1 is a perspective view of an embodiment of a display system made in accordance with the present invention.
Figure 3:
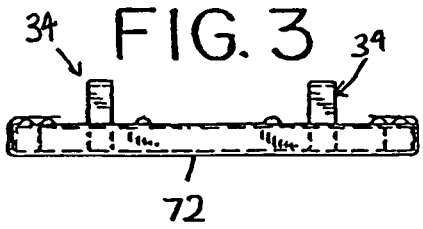
FIG. 3 is an end view of the display system shown in FIG. 1.
Figure 2:
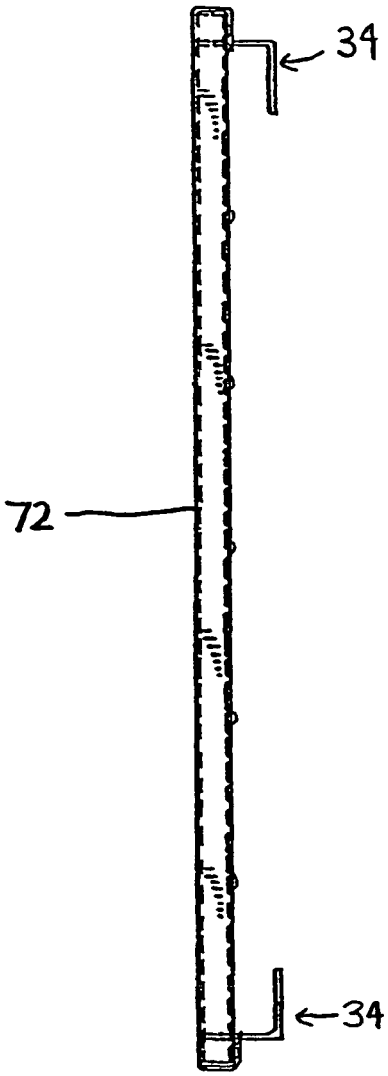
FIG. 2 is a side view of the display system shown in FIG. 1.
Figure 4:
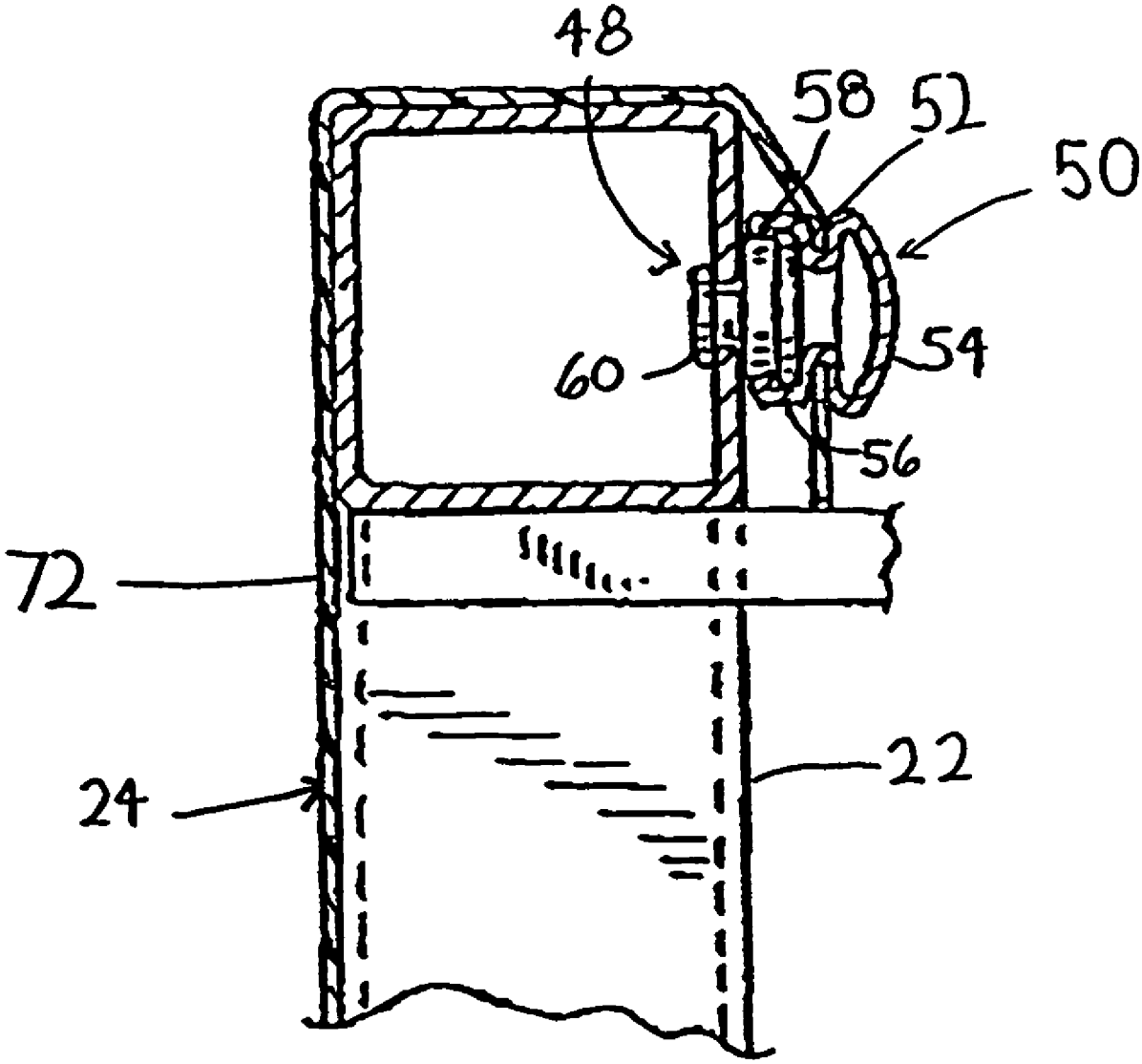
FIG. 4 is an enlarged sectional taken along line 4-4 of FIG. 1.

FIG. 1 illustrates, generally, a first embodiment of the present invention. As shown in FIG. 1, the numeral 20 generally designates a display system that is constructed in accordance with the present invention. Display system 20 includes a support structure 22, a removably attachable display face 24 and cooperating male and female snap members 48, 50 (e.g., see FIG. 4) that allow the display face 24 to be readily attached or detached to the support structure 22 as needed.

Support structure 22 includes a top frame member 26, a bottom frame member 28, a first side frame member 30 and a second side frame member 32. These may be metal tubes, secured to each other by welding. The side frame members 30, 32 have opposite first and second ends and are connected at their first ends by the top frame member 26, and at their second ends by the bottom frame member 28, thereby defining a generally rectangular shape of the support structure 22. Each of the frame members has a front surface 42, a back surface 44 (e.g., see FIG. 5) and an outer or lateral side surface 46 of the support structure 22.

The support structure 22 further includes frame mounting members 34. While the mounting members 34 in this embodiment take the form described hereinafter, it is understood that the mounting members can be of many different forms as may be best suited for mounting to a structure. Indeed, the support structure need not be fixed to a surface at all, but could be free-standing (e.g., an easel). Here, the mounting members 34 are generally L-shaped (angle L's), having a first portion 36 and a second portion 38. The first portion 36 is connected to the support structure 22 by suitable means, such as welding. The second portion 38 has an aperture 40 defined therein such that a screw (not shown) or other suitable attachment means may pass therethrough and into a wall, or other structure, thereby fixedly mounting the support structure 22 to the wall or other structure.

Figure 6:
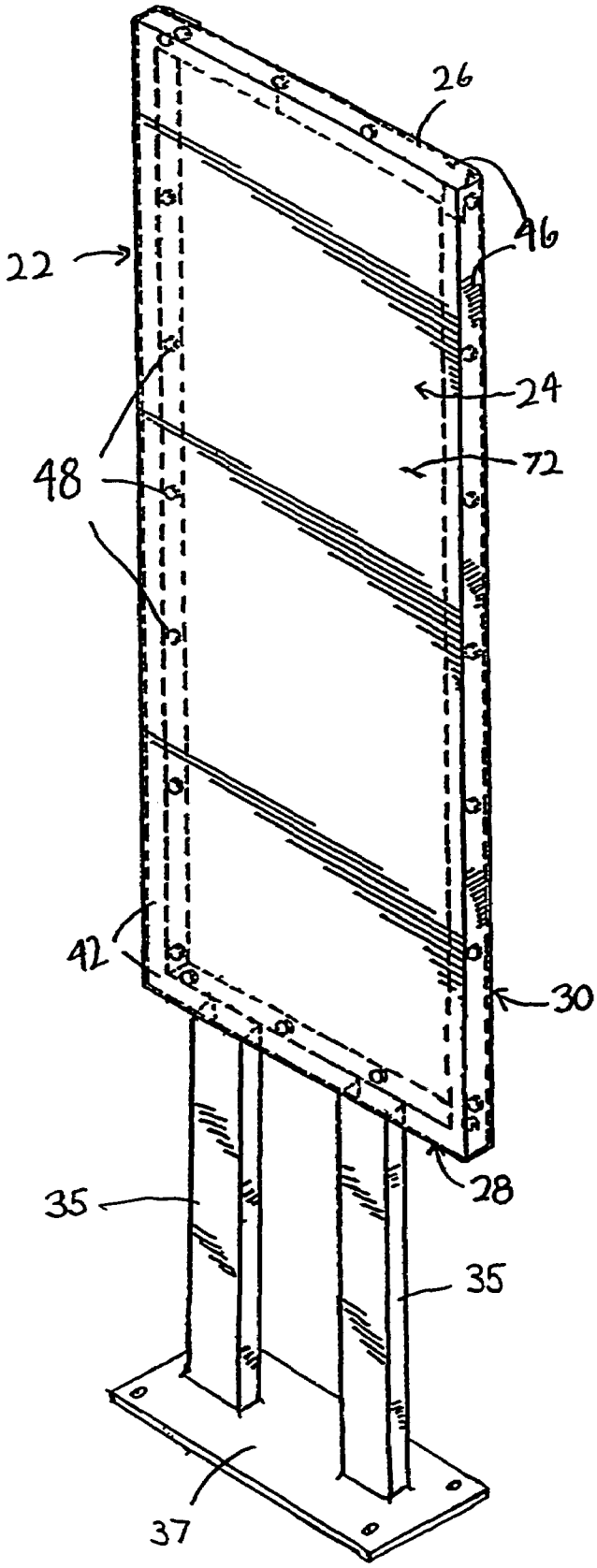
FIG. 6 is a modified embodiment of the FIG. 1 display system employing a different frame support.

FIG. 6 shows a second way of mounting the support structure 22 more appropriate for mounting to a sidewalk or other horizontal surface. In FIG. 6, similar elements are numbered with the same reference numerals with respect to the other Figures. In this embodiment, the support structure 22 includes legs 35, connected to the bottom frame member 28 at one end, and are further connected to a mounting plate 37 at the opposite end. Both of these connections are made by suitable means, such as welding. The mounting plate 37 has apertures 39 therein through which a screw or the like may pass to fasten the mounting plate 37 to the sidewalk. It will be further understood that the support structure need not be an open frame, but could take many different forms, such as a planar member, just to name another.

Figure 5:
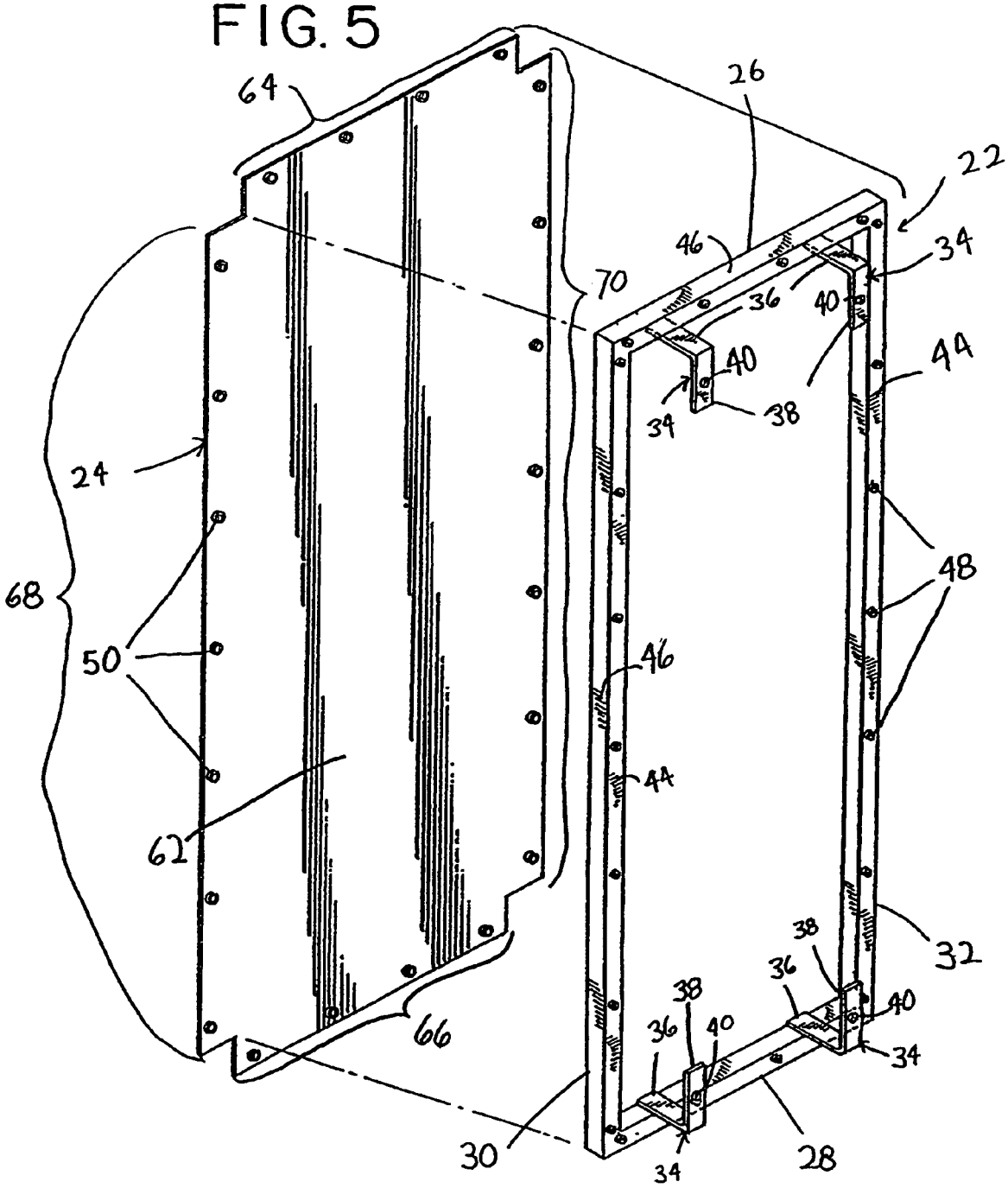
FIG. 5 is an exploded, perspective view of the embodiment of the display system of FIG. 1.

In both embodiments, the display face or signage 24 is formed of a flexible material such as vinyl, having a main portion 62, a top flap portion 64, a bottom flap portion 66 a first side flap portion 68, and a second side flap portion 70 (see FIG. 5 in particular). The main portion 62 is sized and shaped to match the size and shape defined by the front surface 42 of the support structure 22. The top flap portion 64 is sized and shaped to match the length of the top frame member 26, and be able to pass around the outer surface 46 and the back surface 44 of the support structure 22. The bottom flap portion 66 is sized and shaped to match the length of the bottom frame member 28, and be able to pass around the outer surface 46 and the back surface 44 of the support structure 22. The first side flap portion 68 is sized and shaped to match the length of the first side frame member 30, and be able to pass around the outer surface 46 and the back surface 44 of the support structure 22. The second side flap portion 70 is sized and shaped to match the length of the second side frame member 32, and be able to pass around the outer surface 46 and the back surface 44 of the support structure 22.

The back surface 44 has a plurality of male snap members 48 thereon for engaging female snap members 50 on the display face 24. A plurality of female snap members 50 are disposed along the peripheral edges of the top flap portion 64, the bottom flap portion 66 and both first and second side flap portions 68, 70 of the display face 24. In the embodiment shown in FIG. 4, the female snap member 50 includes a dome-like portion 54 and a cup-shaped socket element 56 having an inturned flange 58 along its rim. The female snap member 50 engages the display face 24 between the dome-like portion 54 and the socket element 56. The male snap member 48 is of a generally cylindrical shape, sized and shaped to be received in the female snap member 50, having an outwardly extending circumferential lip 52 at one end that engages the inturned flange 58 of the socket element 56 of the female snap member 50 when inserted therein. The other end of the male snap member 48 is formed generally as a rivet having an outwardly extending anchor portion 60. The male snap member 48 is mounted to the back surface 44 of the support structure 22 through a hole therein. The anchor portion 60 is sized and shaped such that the male snap member 48 cannot be pulled back out through the hole and is thereby locked in the back surface 44.

To attach the display face 24 to the support structure 22, the main portion 62 is simply placed on the front surface 42 such that the top flap portion 64, the bottom flap portion 66 and the first and second side flap portions 68, 70 are matched with the top frame member 26, the bottom frame member 28 and the first and second side frame members 30, 32 respectively, and an advertising surface 72 of the display face 24 is facing forward. The top flap portion 64 is then wrapped around the top frame member 26 and the female snap members 50 on the top flap portion 64 are pressed onto and engage respective male snap members 48 on the back surface 44 of the support structure 22 thereby securing the display face 24 to the support structure 22, and hiding the top frame member 26 from sight. The bottom flap portion 66 is then wrapped around the bottom frame member 28 and the female snap members 50 on the bottom flap portion 66 are pressed onto and engage respective male snap members 48 on the back surface 44 of the support structure 22 thereby further securing the display face 24 to the support structure 22, and hiding the bottom frame member 28 from sight. The first side flap portion 68 is then wrapped around the first side frame member 30 and the female snap members 50 on the first side flap portion 68 are pressed onto and engage respective male snap members 48 on the back surface 44 of the support structure 22 thereby further securing the display face 24 to the support structure 22, and hiding the first side frame member 30 from sight. The second side flap portion 70 is then wrapped around the second side frame member 32 and the female snap members 50 on the second side flap portion 70 are pressed onto and engage respective male snap members 48 on the back surface 44 of the support structure 22 thereby further securing the display face 24 to the support structure 22, and hiding the second side frame member 32 from sight. To remove the display face 24, the top, bottom, first and second side flap portions are simply pulled away from the support structure 22, thereby disengaging the male and female snap members 48, 50.

While the display face 24 is removably attached to the support structure by engagement of male and female snap members 48, 50 in the present embodiment, it is understood that any suitable means may be used so long as it allows for the display face 24 to be attached and detached easily. These could include hook-and-eye fasteners, keyhole fasteners, wing nuts, Velcro, bungee cords, elastically-contracted edges on the signage, and so on. Most preferably, all of these mechanisms and arrangements allow an untrained person to change the signage with ease, while also covering all of the visible support structure.

It should be appreciated that the embodiments described above are to be considered in all respects only illustrative and not restrictive. The scope of the invention is indicated by the following claims rather than by the foregoing description. All changes that come within the meaning and range of equivalents are to be embraced within their scope.

I claim:

1. An indoor as well as outdoor display system having readily changeable planar-type signage comprising:

a signage support structure having a front surface, lateral sides and a back surface; signage having a display face with a generally planar display surface and a contact surface surrounding said display surface, said display face being sized and shaped to fit around said support structure front surface; and a plurality of spaced apart quick-release fasteners for removably attaching said display face contact surface to said support structure at points on one or both of said lateral sides and back surface, said fasteners having at least a part thereof permanently affixed to one of said signage and said support structure, said fasteners being engaged and disengaged by hand without a tool;

wherein said plurality of fasteners each comprise a male snap member and a female snap member, said male snap member being of a generally cylindrical shape having an outwardly extending lip on a first engaging end, and a second end of said male snap member being fixedly attached to one of said back surface of said support structure and said display face contact surface, said female snap member being attached to an other of said display face contact surface and said back surface of said support structure, said female snap member having a rounded button portion and a cup-shaped socket portion defining a second engaging end with an inward flange thereon, said cup-shaped portion being sized and shaped to engage said first engaging end of said male snap member such that said male snap member is received therein by applying pressure to force said lip of said male snap member past said inward flange of said female snap portion, said male snap member then being held in engagement with said female snap member by said inward flange until force is applied to extract said male snap member.

2. A display system as described in claim 1, wherein said female snap members are located at a peripheral edge of said signage display face contact surface, and said male snap members are located on said back surface of said signage support structure.

3. An indoor as well as outdoor display system having readily changeable planar-type signage comprising;

a signage support structure including first and second generally vertical side members, a generally horizontal top member, a generally horizontal bottom member, and top ends and bottom ends, said first side member having one of said top ends and one of said bottom ends, said second side member also having another of said top ends and another of said bottom ends, said top member being attached to said first and second side members at their respective said top ends, said bottom member being attached to said first and second side member at their respective said bottom ends, said top, bottom, first side and second side members defining a front, back and sides of said support structure, said back having a plurality of first fastening means thereon;

a mount for immovably mounting said support structure in a desired location; and a plurality of different display faces having a display surface and a contact surface, said contact surface further having a plurality of spaced apart second fastening means attached thereto that connect to said first fastening means and said back of said support structure, and first and second fastening means being engaged and disengaged by hand without a tool while said support structure is immovably mounted, said display face being sized and shaped to fit around said support structure such that when said first and second fastening means are engaged, said display face is held taut across said support structure and said support structure front and sides are thereby covered, wherein said first fastening means is a male snap member and said second fastening means is a female snap member, said male snap member being of a generally cylindrical shape having an outwardly extending lip on a first engaging end, and a second end, said second end of said male snap member being fixedly attached to said back surface of said support structure, said female snap member being attached to said display face, said female snap member having a rounded button portion and a cup-shaped socket portion defining a second engaging end with an inward flange thereon, said cup-shaped portion being sized and shaped to engage said first end of said male snap member such that said male snap member can be received therein by applying pressure to force said lip of said male snap member past said inward flange of said female snap portion, said male snap member then being held in engagement with said female snap member by said inward flange until force is applied to extract said male snap member.

4. An advertisement display comprising:

a support structure having first and second vertical sides, a horizontal top member, a horizontal bottom member, and top ends and bottom ends, said first side having one of said top ends and one of said bottom ends, said second side also having another of said top ends and another of said bottom ends, said top member being attached to said first and second side members at their respective said top ends, said bottom member being attached to said first and second side members at their respective said bottom ends, said top, bottom, first side and second side members defining a back surface of said support structure, said back surface having first fastener members thereon;

a support structure mount;

a display face having a display surface and a contract surface, said contact surface having spaced apart second fastener members thereon that connect and disconnect to said first fastener members on said back surface of said support member manually without any tool, said display face being sized and shaped to fit snugly around said support structure when said first and second fastener members are in engagement such that tension is created in said display face, wherein said first fastener members are male snap members and said second fastener members are female snap members, each said male snap member being of a generally cylindrical shape having an outwardly extending lip on a first engaging end, and a second end, said second end of said male snap member being fixedly attached to said back surface of said support structure, each said female snap member being attached to said display face, said female snap member having a rounded button portion and a cup-shaped socket portion defining a second engaging end with an inward flange thereon, said cup-shaped portion being sized and shaped to engage said first end of said male snap member such that said male snap member can be received therein by applying pressure to force said lip of said male snap member past said inward flange of said female snap portion, said male snap member then being held in engagement with said female snap member by said inward flange until force is applied to extract said male snap member.

5. A display system having readily hand-changeable planar-type signage, comprising;

removable signage having a display face;

a signage support structure; and a plurality of interengageable releasable fasteners having a first part fixed on one of said signage and support structure and another part on the other of said signage and support structure, said fasteners being manipulated in use by hand without any tool to quickly removably attach said signage to said support structure;

said support structure has a front, sides and a back, said signage being sized to cover said support structure front and sides, and one part of said fasteners is on said back of said support structure;

wherein said fasteners are snap fasteners.

6. A display as described in claim 5 wherein said support structure further includes a mount permanently affixed thereto, said mount having a portion to fixedly attach said mount to a surface, said signage being mounted using said fasteners with said mount in place.

7. A display system having changeable signage that is changeable without tools by a single untrained individual, comprising;

removable signage having a display face;

a signage fastening mechanism comprising a plurality of quick-release interengageable fasteners each including at least a portion thereof attached to one of said signage and another portion thereof attached to said support structure, said fastening mechanism being manipulated by hand to releasably attach said signage to said support structure to attach and also remove said signage by hand without the use of any tool;

a first part and a second part of said fastening mechanism are snap fasteners;

said support structure has a front, sides and a back, said signage being sized to cover said support structure front and sides, said first part being on said back of said support structure.

* * * * *